US010072346B2

(12) United States Patent
Yamabe et al.

(10) Patent No.: US 10,072,346 B2
(45) Date of Patent: Sep. 11, 2018

(54) METHOD FOR PRODUCING METAL AND METHOD FOR PRODUCING REFRACTORY METAL

(71) Applicant: TOHO TITANIUM CO., LTD., Chigasaki-shi, Kanagawa (JP)

(72) Inventors: Takahiro Yamabe, Chigasaki (JP); Yuichi Ono, Chigasaki (JP); Koji Akiyama, Chigasaki (JP); Motoshige Sato, Chigasaki (JP); Bunji Akimoto, Chigasaki (JP)

(73) Assignee: TOHO TITANIUM CO., LTD., Chigasaki-shi (JP)

( * ) Notice: Subject to any disclaimer, the term of this patent is extended or adjusted under 35 U.S.C. 154(b) by 276 days.

(21) Appl. No.: 14/914,196

(22) PCT Filed: May 22, 2015

(86) PCT No.: PCT/JP2015/064701
§ 371 (c)(1),
(2) Date: Feb. 24, 2016

(87) PCT Pub. No.: WO2016/002377
PCT Pub. Date: Jan. 7, 2016

(65) Prior Publication Data

US 2016/0215406 A1 Jul. 28, 2016

(30) Foreign Application Priority Data

Jun. 30, 2014 (JP) ..... 2014-134067

(51) Int. Cl.
*C25C 3/04* (2006.01)
*C25C 3/08* (2006.01)
(Continued)

(52) U.S. Cl.
CPC ..... *C25C 3/04* (2013.01); *C25B 1/006* (2013.01); *C25B 9/063* (2013.01); *C25C 3/08* (2013.01);
(Continued)

(58) Field of Classification Search
CPC ..... C25B 1/006; C25B 9/063; C25C 3/04; C25C 3/08; C25C 3/26; C25C 3/28; C25C 3/34; C25C 7/005
See application file for complete search history.

(56) References Cited

U.S. PATENT DOCUMENTS 4,495,037 A 1/1985 Ishizuka
5,439,563 A 8/1995 Sivilotti
(Continued)

FOREIGN PATENT DOCUMENTS

JP 59-93894 A 5/1984
JP 4-214889 A 8/1992
(Continued)

OTHER PUBLICATIONS

International Preliminary Report on Patentability and the English translation of the Wirtten Opinion of the International Searching Authority (Forms PCT/IB/338, PCT/IB/373 and PCT/ISA/237), dated Jan. 12, 2017, for International Application No. PCT/JP2015/064701.
(Continued)

*Primary Examiner* — Ciel P Thomas
(74) *Attorney, Agent, or Firm* — Birch, Stewart, Kolasch & Birch, LLP

(57) ABSTRACT

Provided is a method for producing metal by molten salt electrolysis, by which the metal can be efficiently produced. A method for producing metal by using an apparatus for molten salt electrolysis having an electrolytic cell and an electrode pair, wherein the molten salt electrolysis in the
(Continued)

electrolytic cell and heating of the molten salt by a Joule heat generation between a pair of electrodes for electrolysis are simultaneously performed; and wherein the apparatus for molten salt electrolysis has at least two sets of electrode pair, and at least one set of the electrode pairs is electrically opened.

6 Claims, 1 Drawing Sheet

(51) Int. Cl.

| | |
|---|---|
| ***C25C 3/34*** | (2006.01) |
| ***C25B 1/00*** | (2006.01) |
| ***C25B 9/06*** | (2006.01) |
| ***C25C 3/26*** | (2006.01) |
| ***C25C 3/28*** | (2006.01) |
| ***C25C 7/00*** | (2006.01) |

(52) U.S. Cl.
CPC ..... *C25C 3/26* (2013.01); *C25C 3/28* (2013.01); *C25C 3/34* (2013.01); *C25C 7/005* (2013.01)

(56) References Cited

U.S. PATENT DOCUMENTS

| | | | | |
|---|---|---|---|---|
| 6,066,247 | A * | 5/2000 | Sharma | C25C 3/06 205/372 |
| 2009/0226341 | A1 | 9/2009 | Shindo | |

FOREIGN PATENT DOCUMENTS

| | | | |
|---|---|---|---|
| JP | 2003-306789 | A | 10/2003 |
| JP | 2005-89801 | A | 4/2005 |
| JP | 2012-172194 | A | 9/2012 |
| JP | 2012-251221 | A | 12/2012 |
| SU | 582332 | A | 11/1977 |
| WO | WO 2007/007498 | A1 | 1/2007 |

OTHER PUBLICATIONS

International Search Report, dated Aug. 25, 2015, for International Application No. PCT/JP2015/064701.

* cited by examiner

[Figure 1]
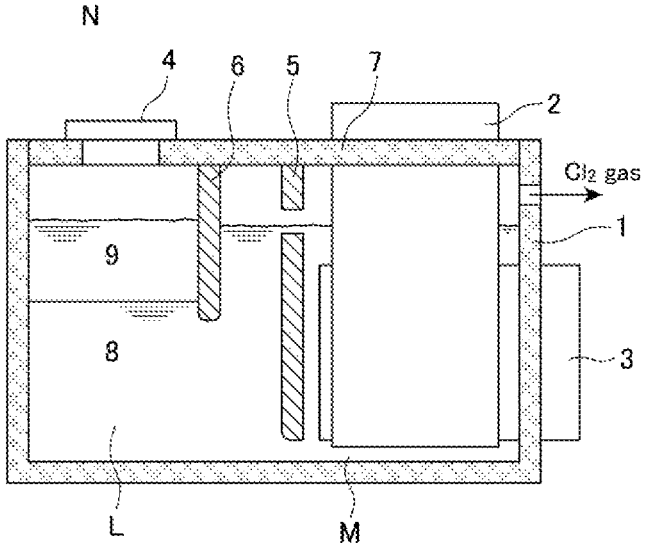
[Figure 2]
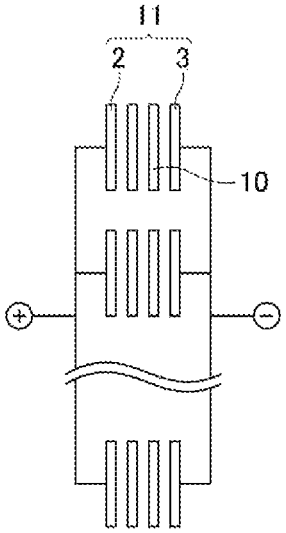

METHOD FOR PRODUCING METAL AND METHOD FOR PRODUCING REFRACTORY METAL

TECHNICAL FIELD

The present invention relates to a method for producing metal by molten salt electrolysis, and in particular, an efficient method for producing metal by performing the molten salt electrolysis in an electrolytic cell and heating of the molten salt by a Joule heat generation from an electrode pair for performing electrolysis simultaneously. Furthermore, the present invention relates to a method for producing refractory metal by using the metal as obtained above.

BACKGROUND ART

In general, the production of a metal by using an apparatus for a molten salt electrolysis is performed by electrolysis for oxidizing and reducing a metal salt in a molten state on the surface of an electrode pair. The apparatus for molten salt electrolysis is designed so that the heat balance is maintained by taking into consideration heat generated from the electrode pair during the electrolysis process and heat insulation of the electrolytic cell. In addition, the electrolysis process is operated incorporating ways and means so as to eliminate thermal disturbance generated in case of supplying a molten salt into the apparatus for molten salt electrolysis during the electrolysis. However, there may be the case where a temperature of the molten salt turns into a tendency of the descending or ascending due to various factors. In the case where the temperature of the molten salt descends, a part of the molten salt is solidified, and continuation of the electrolysis is impossible, and therefore, the heating of the molten salt is required. Conversely, in the case where the temperature of the molten salt ascends, a re-reaction between electrolyzed metal and produced gas increases to cause a descending of the current efficiency, and therefore, the cooling of the electrolytic cell becomes necessary.

In addition, the heating of molten salt is required, at the time of a starting up of the production of metal. Here, the terms "at the time of starting up of the production of metal" mean the time immediately after charging a molten salt, prepared in a separate vessel, into the electrolytic cell. At this point, the molten salt is in contact with the wall surface of the electrolytic cell, whereby some amount of the heat in the molten salt is removed, and therefore, heating for the molten salt up to the working temperature becomes necessary. In an extreme case, there is a concern that the molten salt is partially solidified between a pair of electrodes, thereby causing a situation where normal electrolysis is not able to be performed.

Under the foregoing circumstances, there have been proposed various technologies regarding the temperature control of the molten salt in the apparatus for molten salt electrolysis.

For example, as disclosed in PTLs 1 and 2, there is a known method in which a heat exchanger with a built-in gas burner is installed in an electrolytic cell of an apparatus for molten salt electrolysis, and electrolysis is performed while controlling heating or cooling by the heat exchanger such that a molten salt is kept in the completely molten state.

However, in order that at the time of starting up of the electrolytic cell, the molten salt is heated and kept in the completely molten state only by the heat exchanger with a built-in gas burner before it is solidified, it is necessary to install a heat exchanger equipped with a considerably large number of gas burners in the electrolytic cell, and hence, such state is not economical.

In addition, as disclosed in PTL 3, there is also a known means for supplying gas which has been pre-heated in another unit of an electrolytic cell into an interior of the electrolytic cell thereof, which means thereby heating a molten salt.

However, moisture formed as a by-product of gas combustion is contained in the combustion gas produced in another unit, and therefore, if this gas is carried into the electrolytic cell, not only an electric power is consumed for the electrolysis of water from the moisture absorbed into the molten salt, but also an electrode is oxidized by an oxygen gas produced by the water electrolysis, and thus, an undesirable phenomenon may arises.

In this way, in the method for producing metal by using apparatus for molten salt electrolysis, in particular, a method for efficiently heating the molten salt, the electrolysis process is desired without causing inconvenience.

CITATION LIST

Patent Literature

PTL 1: JP-A-H04-214889
PTL 2: JP-A-2005-089801
PTL 3: JP-A-2012-251221

SUMMARY OF INVENTION

Technical Problem

The present invention is to solve the above-described problem, and an object thereof is to provide a method for efficiently producing metal by molten salt electrolysis without causing inconvenience in an electrolytic cell.

Solution to Problem

The present inventors have made extensive and intensive investigations regarding the above-described problem. As a result, it has been found that metal can be efficiently produced by heating of a molten salt utilizing a Joule heat generation from an electrode pair for performing electrolysis to the maximum extent possible without descending the efficiency of the molten salt electrolysis in an electrolytic cell, leading to accomplishment of the present invention.

Specifically, as shown below, the method for producing metal according to the present invention is concerned with a method for producing metal by the molten salt electrolysis with an electrolytic cell and an electrode pair, which is characterized in that the molten salt electrolysis in the electrolytic cell and optimum heating of the molten salt by a Joule heat generation from an electrode pair for the electrolysis are simultaneously performed; and wherein the apparatus for molten salt electrolysis has at least two sets of electrode pair, and at least one set of the electrode pairs is opened.

(1) A method for producing metal by using an apparatus for molten salt electrolysis having an electrolytic cell and an electrode pair, wherein the molten salt electrolysis in the electrolytic cell and heating of the molten salt by a Joule heat generation between a pair of electrodes for electrolysis are simultaneously performed; and wherein the apparatus for molten salt electrolysis has at least two sets of electrode pair, and at least one set of the electrode pairs is electrically opened.

(2) The method for producing metal according to (1), wherein the electrically non-opened electrode pair is arranged such that the molten salt is uniformly heated by a Joule heat generation in the neighborhood of the electrically non-opened electrode pair.

(3) The method for producing metal according to (1) or (2), wherein the electrolytic cell is a bipolar cell.

(4) The method for producing metal according to any one of (1) to (3), wherein the electrically opened electrode pair is connected after the molten salt in the electrolytic cell is completely kept in the molten state.

(5) The method for producing metal according to any one of (1) to (4), wherein the metal is magnesium, aluminum, or zinc.

(6) A method for producing refractory metal, which is characterized by reducing metal chloride by using at least one metal selected from the metal according to (5).

(7) The method for producing refractory metal according to (6), wherein the refractory metal is any one of titanium, zirconium, hafnium, and silicon.

Here, it is meant by the terms "the electrode pair is electrically opened" mean that the electrode pair is not connected to a power source, and more specifically, it is meant that the electrode pair is not connected to a busbar connected to the power source. The electrolysis of the molten salt is not performed between the opened electrodes.

In the production method of metal according to the present invention, it is preferred that the electrically non-opened electrode pair is arranged such that the molten salt is uniformly heated by a Joule heat generation in the neighborhood of the electrically non-opened electrode pair.

Specifically, it is preferred that at the early stages of operation, the electrically non-opened electrode pair is arranged near the wall surface of the electrolytic cell, in which the heat is considered to be insufficient, and in the center of the electrolytic cell with excellent heating efficiency.

In a preferred embodiment, in the case wherein an apparatus for molten salt electrolysis have five sets of electrode pair which are arranged in a line at regular intervals and two sets of electrode pair are electrically opened, it is preferred to perform the electrolysis by electrically opening the second and fourth electrode pairs from the near side (namely, by electrically activating the first, third, and fifth electrode pairs). By electrically opening the electrode pairs in such a mode, the molten salt can be efficiently heated due to the increase of a Joule heat generation from the electrode pair for performing electrolysis.

In addition, in another preferred embodiment, in the case where in an apparatus for molten salt electrolysis have seven sets of electrode pair arranged in a line at regular intervals and three sets of electrode pair are electrically opened, it is preferred to perform the electrolysis by electrically opening the second, fourth, and sixth electrode pairs from the near side (namely, by electrically activating the first, third, fifth, and seventh electrode pairs).

In still another preferred embodiment, the present invention is also applicable to the case wherein an apparatus for molten salt electrolysis have ten sets of electrode pair arranged in a line at regular intervals and three sets of electrode pair are electrically opened. In this case, it is preferred to perform the electrolysis by electrically opening the third, fifth, and seventh electrode pairs from the near side. In addition, in the case wherein the temperature turns into a tendency of ascending based on a temperature balance of the electrolytic cell, such a mode can also be taken that the fifth electrode pair is electrically connected to the power source, whereas the two sets of third and seventh electrode pairs are electrically opened.

In the production method of metal according to the present invention, in the case of electrically opening at least one set of electrode pair, from the viewpoint of uniformity of a flow of the molten salt within a metal electrolysis chamber or a heat balance of the electrolytic cell, the electrode pair is electrically opened in the number preferably ranging from 10% to 50%, more preferably ranging from 10% to 40%, and still more preferably ranging from 10% to 30% relative to the total number of electrode pairs.

In the present invention, by electrically opening the electrode pair in the range of from 10% to 70% among the electrode pairs, there is brought such an effect that heating of the molten salt can be performed safely (not causing a gas leak, etc.) and inexpensively (not costing additional equipment) as compared with the case of heating of the molten salt by additional equipment, such as gas burners, etc.

Furthermore, the temporary termination of the production (the temporary termination of the electrolysis) does not occur due to a response to malfunction or maintenance work to be carried out on the occasion of installing the heating equipment since the additional heating equipment is unnecessary. Therefore, there is brought such an effect that a heating operation of the electrolytic cell can be efficiently performed.

It is to be noted that the electrical opening or connection of the electrode pair is performed by the following apparatus. That is, the apparatus has a feature that the connection or disconnection of an anode or a cathode to a so-called electrode-connecting busbar for connecting a main busbar of supplying a current thereinto can be remotely controlled.

By taking the above-described structure, there are brought such effects that the connection between a power source busbar and a power source can be smoothly conducted; and that the electrolytic cell can be efficiently operated.

It is to be noted that the electrode pair used in the production method of metal according to the present invention is not particularly limited so long as it is a usual electrode pair to be subjected to the production of metal by means of electrolysis. As the anode, for example, a carbon graphite electrode and the like can be used. In addition, as the cathode, for example, an iron electrode and the like can be used.

In the production method of metal according to the present invention, the electrolytic cell is preferably a bipolar cell.

In the bipolar cell, a bipolar electrode intervenes between the electrode pairs, and an electrolytic reaction can be conducted even on the bipolar electrode. Therefore, the bipolar cell is preferred from the standpoints of good productivity (in the case of taking into consideration the equipment scale) and electric power saving.

Though the bipolar electrode is not particularly limited so long as it is a usual bipolar electrode which is used for the bipolar cell, for example, carbon graphite and the like can be used.

In the production method of metal according to the present invention, it is preferred that after charging the molten salt into the electrolytic cell, the electrically opened electrode pair is connected.

Here, it is meant by the terms "the electrically opened electrode pair is connected" that the electrically opened electrode pair is rendered in an active state, and more specifically, it is meant that the busbar connected to the power source is turned from an electrically non-connected state to a connected state to the electrode pair. The electrolysis of the molten salt is performed between the connected electrodes.

Though the metal produced by the method according to the present invention is not particularly limited so long as it is able to be produced by the apparatus for molten salt electrolysis, it is preferably magnesium, aluminum, or zinc.

The method for producing refractory metal according to the present invention is characterized by reducing metal chloride by using at least one metal selected from the above-described metal.

In addition, the refractory metal in the production method of refractory metal according to the present invention is preferably titanium, zirconium, hafnium, or silicon.

Though the power source of the electrode pair, which is used for the production method of metal according to the present invention, is not particularly limited, it is preferred to use a power source in a form where a total sum of currents flowing through the electrode pair is constant (constant-current power source) such that the progress of the electrolysis is not changed due to the presence or absence of opening of other electrode pairs.

When the production method of metal according to the present invention is performed at the time of starting up of the production of metal by the apparatus for molten salt electrolysis, its effect is much more exhibited, and hence, such is preferred. Here, the terms "at the time of starting up of the production of metal" represent the contents as described above.

It is to be noted that at the time of starting up of the production of metal, at least the molten salt in the surroundings of the electrode pair is kept in a molten state, and the electrolysis can be commenced.

In the production method of metal according to the present invention, an additional heat source other than the Joule heat generation from the electrode pair may be supplementarily used in combination.

In the case of using an additional heat source in combination, the molten salt can be kept completely in the molten state for a shorter time than that in the case of not using an additional heat source in combination.

Though the additional heat source is not particularly limited so long as it does not hinder the production method of metal according to the present invention, it is preferred to use a heat exchanger. As the heat exchanger, for example, the dipping type heat exchangers described in the above-cited PTL 1 or 2 can be used.

In the production method of metal according to the present invention, in the case of using a heat exchanger, it is preferred that the heat exchanger is installed in the electrolytic cell, and the molten salt which has been molten in a separate vessel is charged into the electrolytic cell in a state where the heat exchanger is kept in a heated state.

Advantageous Effects of Invention

The production method of metal according to the present invention brings about an effect that the method makes it possible to produce metal simply and efficiently by simultaneously performing molten salt electrolysis in an electrolytic cell and effectively heating of a molten salt by controlling the amount of a Joule heat generation from an electrode pair for performing electrolysis.

BRIEF DESCRIPTION OF DRAWINGS

FIG. 1 It is a diagrammatic view of an apparatus for molten salt electrolysis.

FIG. 2 It is a diagrammatic view showing a mode and a connecting method of electrode pairs.

DESCRIPTION OF EMBODIMENTS

A preferred embodiment of the production method of metal according to the present invention is explained by using schematic views of an apparatus for molten salt electrolysis which can be used in the present invention and also a mode and a connecting method of electrode pair.

As shown in FIG. 1, an apparatus for molten salt electrolysis N is surrounded by walls of an electrolytic cell 1 and a ceiling wall 7 each constituted of a refractory, and a first wall 5 and a second wall 6 partitioning a metal storing chamber L and an electrolysis chamber M from each other are installed in an interior of the apparatus for molten salt electrolysis N.

An electrolytic bath 8 filled with a molten salt is installed into the metal storing chamber L and the electrolysis chamber M, and furthermore, an anode 2 and a cathode 3 constituting an electrode pair are dipped and arranged in the electrolytic bath 8 of the electrolysis chamber M. In addition, non-illustrated plural bipolar electrodes are interposed between the anode 2 and the cathode 3.

In particular, it is preferred to perform the production method of metal according to the present invention in a state where the apparatus for molten salt electrolysis N has at least two sets of electrode pair constituted of the anode 2 and the cathode 3, and at least one set of the electrode pairs is electrically opened. According to this way, the temperature of the electrolytic bath 8 can effectively ascend while being activated between the non-opened anode 2 and cathode 3 installed in the apparatus for molten salt electrolysis N to perform electrolysis of the molten salt.

FIG. 2 schematically expresses an electrode pair 11 composed of the anode 2 and the cathode 3 installed in the apparatus for molten salt electrolysis N and a bipolar electrode 10 installed therebetween. FIG. 2 expresses the state where three or more sets of electrode pair having two bipolar electrodes arranged therein are connected in parallel. These electrode pairs are connected to a non-illustrated constant-current power source (rectifier via a main busbar).

In an embodiment shown in FIG. 2, by electrically opening a part of the sets among the plural sets of electrode pair, the electrically opened electrode pair is not activated, and the applied voltage is constant, and therefore, the amount of energization of the electrode pair connected to the power source can be increased by an amount corresponding to that portion.

As a result, the amount of a Joule heat generation can be increased on the electrically non-opened electrode pair. As a result, the Joule heat generation in the molten salt intervening between the electrode pairs can be increased, thereby bringing about an effect that the temperature of the electrolytic bath 8 can be efficiently increased.

That is, a current (I) flowing through the plural electrode pairs increases, and when a resistance related to the electrolytic bath existing between the electrodes is designated as R, this means that the current flowing through the electrolytic bath existing between the electrode pairs increases. That is, a Joule heat generation W between the electrodes is calculated by $I^2R$ and exceeds a decrement of the Joule heat generation following the opening of a pair of electrodes.

When this is expressed by a general formula, the Joule heat generation W relative to sets of electrode pair in the number of n is defined as $n*(I/n)^2R$, and this can be expressed in the form of $I^2R/n$.

The Joule heat generation W, that is $I^2R/n$, generated in the electrolytic bath means that the smaller the number of electrode pairs during the operation, the more increased the amount of heat generated in the electrolytic bath.

Accordingly, in the case where the temperature of the electrolytic bath turns into a tendency of descending, it is effective to decrease the number of electrode pairs in the operated state, thereby increasing the amount of heat generated in the electrolytic bath.

Conversely, in the case where the temperature of the electric cell turns into a tendency of ascending, by increasing the number of operating electrodes, the amount of heat generated in the electrolytic bath can be suppressed, resulting in an effect that the temperature of the electrolytic bath can effectively descend.

Though the metal which is produced by the method according to the present invention is not particularly limited so long as it can be produced by the apparatus for molten salt electrolysis, it is preferably magnesium, aluminum, or zinc.

By allowing the metal which is produced by the method according to the present invention to react with metal chloride as a reducing agent, refractory metal can be obtained. For example, by allowing magnesium which is produced by the method according to the present invention to react with titanium chloride, zirconium chloride, or hafnium chloride, refractory metal, such as titanium, zirconium, hafnium, etc., can be produced. In addition, as for zinc which is produced by the method according to the present invention, by using silicon chloride as a reducing agent, silicon can be produced.

EXAMPLES

Example 1

The apparatus for molten salt electrolysis N shown in FIG. 1 was prepared. The apparatus for molten salt electrolysis N has ten sets of electrode pair connected in parallel to a constant-current power source, three bipolar electrodes are arranged between the anode 2 and the cathode 3 constituting each of the electrode pairs, and a heat exchanger is installed in the electrolytic cell.

A molten magnesium salt in a separate vessel was charged into the electrolytic cell 1 of the apparatus for molten salt electrolysis N where the heat exchanger was kept in the heated state.

Subsequently, among the ten sets of electrode pair, seven sets of electrode pair were rendered in a connected state (three sets of electrode pair (electrode pairs of 30% of the total number of electrode pairs) were opened), and electrolysis was commenced. In addition, the heat exchanger was continuously kept in the heated state even during the electrolysis.

On the seven sets of electrode pair, chlorine gas and molten metallic magnesium were smoothly produced immediately after energization. In addition, the metal salt solidified on the wall surface and the like was smoothly rendered in a molten state, and after a while, the solidified metal salt vanished, whereby it was fully rendered in a molten state.

After the vanish of the solidified metal salt was confirmed through visual inspection, the electrically opened electrode pairs were connected, whereby the electrolysis of the molten salt by the ten sets of electrode pair in total could be performed.

A time necessary for arriving at a target temperature from the starting of the electrolysis apparatus was measured.

In addition, when titanium tetrachloride was reduced by using the produced magnesium to produce titanium, titanium could be produced without causing any problem.

Example 2

The molten salt electrolysis was conducted under the same conditions as those in Example 1, except for performing molten salt electrolysis by using an electrolytic cell using nine sets of electrode pair in place of the ten sets of electrode pair and further using three sets of electrode pair as the electrode pairs of electrically opened electrodes (30% of the total number of electrode pairs), and a time necessary for arriving at a target temperature from the starting of the electrolysis apparatus was measured. It is to be noted that when titanium tetrachloride was reduced by using the produced magnesium to produce titanium, titanium could be produced without causing any problem.

Comparative Example 1

An electrolysis cell was started in the same method as that described in Example 1, except that in all of the steps of electrolysis, all of the electrode pairs (ten sets) were connected to a power source without electrically opening a part of the electrode pairs. After commencing the starting operation of the electrolytic cell, the temperature of the molten salt exhibited a tendency of ascending; however, as compared with Example 1, a time required from starting of the electrolysis apparatus to arrival at a target preset temperature increased by an extra of about 50%.

As described above, it was confirmed that the time necessary for arriving at a target preset temperature from the starting of the electrolysis apparatus is delayed as compared with that in Example 1.

It may be considered that in the production method of magnesium in Example 1, in contrast, by electrically opening a part of the electrode pairs dipped and arranged in the molten salt, a Joule heat generation between the non-opened electrodes can be increased, and as a result, in Example 1, the temperature ascending time of the molten salt could be hastened as compared with that in Comparative Example 1.

In addition, it may be considered that by electrically opening a part of the dipped and arranged electrode pairs, the electrolysis operation of the molten salt could be advanced from the time of starting of the electrolysis apparatus.

INDUSTRIAL APPLICABILITY

The present invention can be applied to the production method for efficiently producing metal by using apparatus for molten salt electrolysis.

REFERENCE SIGNS LIST

1: Electrolytic cell
2: Anode
3: Cathode
4: Lid
5: First wall
6: Second wall
7: Ceiling wall
8: Electrolytic bath
9: Molten magnesium
10: Bipolar electrode
11: Electrode pair L: Metal storing chamber M: Electrolysis chamber N: Apparatus for molten salt electrolysis

The invention claimed is:

1. A method for producing metal by using an apparatus for molten salt electrolysis having an electrolytic cell and at least two electrode pairs, wherein the molten salt electrolysis in the electrolytic cell and heating of the molten salt by Joule heat generated by a pair of electrodes for electrolysis of the at least two electrode pairs are simultaneously performed; wherein at least one electrode pair of the at least two electrode pairs is electrically opened, and wherein the at least one electrically opened electrode pair is connected after the molten salt in the electrolytic cell is completely kept in the molten state.

2. The method for producing metal according to claim 1, wherein an electrically non-opened electrode pair of the at least two electrode pairs is arranged such that the molten salt is uniformly heated by a Joule heat generation in the neighborhood of the electrically non-opened electrode pair.

3. The method for producing metal according to claim 1, wherein the electrolytic cell is a bipolar cell.

4. The method for producing metal according to claim 1, wherein the metal is magnesium, aluminum, or zinc.

5. A method for producing refractory metal comprising, producing magnesium, aluminum, or zinc using the method of claim 4; and reducing metal chloride by using the magnesium, aluminum, or zinc produced.

6. The method for producing refractory metal according to claim 5, wherein the refractory metal is any one of titanium, zirconium, hafnium, and silicon.

* * * * *